US010841692B2

(12) United States Patent
Jung et al.

(10) Patent No.: US 10,841,692 B2
(45) Date of Patent: Nov. 17, 2020

(54) DISPLAY APPARATUS INCLUDING A DIRECTIONAL SOUND GUIDE

(71) Applicant: SAMSUNG ELECTRONICS CO., LTD., Suwon-si (KR)

(72) Inventors: Donghyun Jung, Suwon-si (KR); Sangchul Ko, Suwon-si (KR); Dongkyu Park, Suwon-si (KR); Byeongseob Ko, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/681,264

(22) Filed: Nov. 12, 2019

(65) Prior Publication Data

US 2020/0162810 A1 May 21, 2020

(30) Foreign Application Priority Data

Nov. 15, 2018 (KR) ..... 10-2018-0140871

(51) Int. Cl.
*H04R 1/34* (2006.01)
*H04R 1/02* (2006.01)

(52) U.S. Cl.
CPC ..... *H04R 1/345* (2013.01); *H04R 1/028* (2013.01); *H04R 2499/15* (2013.01)

(58) Field of Classification Search
CPC combination set(s) only.
See application file for complete search history.

(56) References Cited

U.S. PATENT DOCUMENTS 8,638,973 B2 1/2014 Hayashi et al.
8,768,405 B2 7/2014 Fukazawa et al.
(Continued)

FOREIGN PATENT DOCUMENTS

JP 2000-059874 A 2/2000
KR 10-2018-0066923 A 6/2018
(Continued)

OTHER PUBLICATIONS

Holland, K., et al., "A Low-Cost End-Fire Acoustic Radiator", Jul./Aug. 1991, J. Audio Eng. Soc, vol. 39, No. 7/8, p. 540-550, 11 pages total.

(Continued)

*Primary Examiner* — Duc Nguyen
*Assistant Examiner* — Assad Mohammed
(74) *Attorney, Agent, or Firm* — Sughrue Mion, PLLC

(57) ABSTRACT

A display apparatus includes: a display configured to display an image; a housing configured to support the display; a loudspeaker provided between the display and the housing and configured to output sound; and a sound guide provided on the loudspeaker and configured to guide the sound output by the loudspeaker. The sound guide may include comprise: a directional emitter including: an internal space extending in a first output direction of the sound; and a plurality of holes arranged in the output direction on a first surface facing a second output direction different from the first output direction; and one pair of directional guides protruding from the first surface, the plurality of holes of the directional emitter being interposed between the one pair of directional guides, the one pair of directional guides approaching each other in the second output.

20 Claims, 26 Drawing Sheets

(56) References Cited

U.S. PATENT DOCUMENTS

| | | | | |
|---|---|---|---|---|
| 9,459,654 | B2 | 10/2016 | Horiuchi | |
| 9,930,286 | B2 | 3/2018 | Hamadate | |
| 2009/0080681 | A1 | 3/2009 | Hamada et al. | |
| 2009/0274329 | A1 * | 11/2009 | Ickler | G10K 11/26 381/338 |
| 2011/0305359 | A1 | 12/2011 | Ikeda et al. | |
| 2013/0028464 | A1 | 1/2013 | Hayashi et al. | |
| 2013/0114844 | A1 | 5/2013 | Fukazawa et al. | |
| 2013/0329927 | A1 * | 12/2013 | Samarakoon | H04R 1/345 381/333 |
| 2014/0247959 | A1 | 9/2014 | Yamanaka et al. | |
| 2015/0053497 | A1 | 2/2015 | Horiuchi | |
| 2015/0326816 | A1 | 11/2015 | Hamadate | |
| 2018/0167724 | A1 | 6/2018 | Jung et al. | |

FOREIGN PATENT DOCUMENTS

| | | | | |
|---|---|---|---|---|
| KR | 10-2019-0021602 | A | 3/2019 | |
| WO | WO-2016134861 | A1 * | 9/2016 | H04R 1/345 |

OTHER PUBLICATIONS

International Search Report and Written Opinion (PCT/ISA/210 and PCT/ISA/237), dated Apr. 20, 2020 by International Searching Authority in International Application No. PCT/KR2019/014874.

* cited by examiner

DISPLAY APPARATUS INCLUDING A DIRECTIONAL SOUND GUIDE

CROSS-REFERENCE TO RELATED THE APPLICATION

This application is based on and claims priority under 35 U.S.C. § 119 to Korean Patent Application No. 10-2018-0140871 filed on Nov. 15, 2018 in the Korean Intellectual Property Office, the disclosure of which is incorporated herein by reference in its entirety.

BACKGROUND

Field

The disclosure relates to a display apparatus, and more particularly to a display apparatus capable of providing high-quality sound.

Description of the Related Art

Most display apparatuses include internal loudspeakers to output sound together with an image.

Recently, display apparatuses are being manufactured in a slim type. However, the display apparatuses being a slim type lead to a poor condition for producing high quality sound. In particular, it is difficult to provide quality sound with a sound field effect.

A directional loudspeaker may be used to make the sound field effect better in a slim display device.

However, even when the directional loudspeaker is used in a display apparatus, sound output from the directional loudspeaker may be confined or reflected within the housing of the display apparatus. For this reason, directionality of sound and the sound field effect may be deteriorated and other related problems of poor sound quality occurs.

SUMMARY

An aspect of one or more embodiments is to provide a display apparatus for providing high-quality sound.

In accordance with an aspect of the disclosure, there is provided a display apparatus including: a display configured to display an image; a housing configured to support the display; a loudspeaker provided between the display and the housing and configured to output sound; and a sound guide provided on the loudspeaker and configured to guide the sound output by the loudspeaker. The sound guide may include comprise: a directional emitter including: an internal space extending in a first output direction of the sound; and a plurality of holes arranged in the output direction on a first surface facing a second output direction different from the first output direction; and one pair of directional guides protruding from the first surface, the plurality of holes of the directional emitter being interposed between the one pair of directional guides, the one pair of directional guides approaching each other in the second output.

The one pair of directional guides may be symmetrical to each other.

The housing may include vents through which the sound output from the loudspeaker passes to an exterior of the housing.

An edge of at least one of the one pair of directional guides may extend in the second output direction.

The sound guide may be disposed to be tilted by a predetermined angle toward the vents with respect to the second output direction.

The first surface may correspond to an upper surface of the directional guide. A first side surface and a second side surface of the directional guide, which are adjacent to the first surface and face each other to form the internal space, may have different heights in the second output direction.

The one pair of directional guides may include: a first directional guide; and a second directional guide. The first directional guide, provided closer to the vents than the second directional guide, may have a shorter length than the second directional guide in the second output direction.

The one pair of directional guides may include: a first directional guide; and a second directional guide. The first directional guide, provided closer to the vents than the second directional guide, may have a longer length than the second directional guide in the second output direction.

At least one of the one pair of directional guides may be concave or convex.

At least one of the one pair of directional guides may include a bent portion.

The one pair of directional guides and the vents may be integrally provided.

In accordance with an aspect of the disclosure, there is provided a display apparatus including a housing configured to support a display displaying an image and comprising a plurality of gaps; a loudspeaker provided in the housing and configured to output sound through the plurality of gaps; and a sound guide configured to guide the sound output by the loudspeaker to the plurality of gaps. The sound guide may include: a directional emitter configured to guide the sound in a first direction and including a plurality of holes arranged on a first surface of the sound guide, the plurality of holes facing a second direction different from the first direction; a first directional guide; and a second directional guide, the first directional guide and the second directional guide protruding from the first surface toward the plurality of gaps. The first directional guide and the second directional guide configured to further change the sound transmitted through the plurality of holes in the second direction toward the plurality of gaps.

An edge of one of the first directional guide and the second directional guide may extend in the second direction beyond an edge of the other one of the first directional guide and the second directional guide.

The sound guide may be tilted with respect to the second direction by a predetermined angle toward the plurality of gaps.

At least one of the first directional guide and the second directional guide may be concave or convex.

At least one of the first directional guide and the second directional guide may include a bent portion.

The first directional guide, the second directional guide and the plurality of gaps may be integrally provided.

In accordance with an aspect of the disclosure, there is provided a display apparatus including: a housing configured to support a display displaying an image and comprising vents; a loudspeaker provided in the housing and configured to output sound through the vents of the housing; and a sound guide configured to guide the sound output by the loudspeaker to the vents. The sound guide may include: a directional emitter configured to guide the sound in a first direction and comprising a plurality of holes arranged on a first surface of the sound guide, the plurality of holes facing a second direction being perpendicular from the first direction; a first directional guide; and a second directional guide, the first directional guide and the second directional guide protruding from the first surface toward the vents. The sound guide is tilted with respect to the second direction toward the vents.

BRIEF DESCRIPTION OF THE DRAWINGS

The above and/or the aspects of the disclosure will become apparent and more readily appreciated from the following description of embodiments, taken in conjunction with the accompanying drawings, in which.

DETAILED DESCRIPTION

Figure 1:
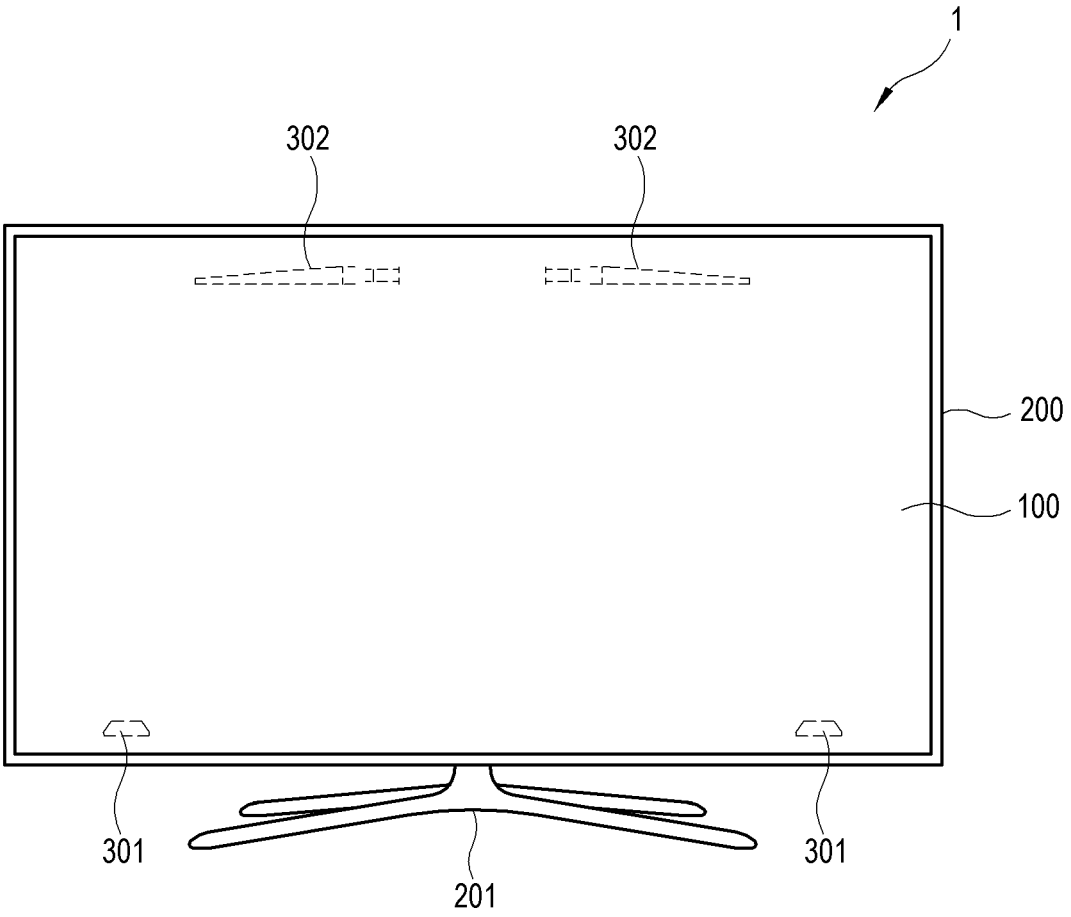
FIG. 1 is a diagram illustrating a display apparatus according to an embodiment of the disclosure.

Hereinafter, embodiments of the disclosure will be described in detail with reference to the accompanying drawings. Throughout the drawings, like reference numerals or signs represent components performing substantially the same function. In the drawings, the size of each component may be exaggerated for clarity and convenience of description. However, the technical spirit, fundamental configuration, and effects of the inventive concept are not limited to configurations or effects described in the following embodiments. In describing the disclosure, detailed description of a well-known art or configuration related to the disclosure will be omitted when it is deemed to unnecessarily obscure the gist of the disclosure.

The terms including ordinal numbers, such as "first" and "second," are used only for distinguishing one element from other elements. Singular expressions, unless clearly defined otherwise in context, include plural expressions. It should be understood that the terms "comprise," "include," "have," etc. do not preclude the presence or addition of one or more other features, numbers, steps, operations, components, parts, or combinations thereof. In embodiments of the disclosure, the terms including "upper portion," "lower portion," "left side," "right side," "upper surface," and "lower surface" are defined on the basis of the drawings, and the shape or location of each component is not limited by the terms. Also, in embodiments of the disclosure, at least one of a plurality of elements indicates all the elements, each of the elements, or all combinations of the elements.

FIG. 1 is a diagram illustrating a display apparatus 1 according to an embodiment of the disclosure. A display apparatus 1 according to an embodiment of the disclosure may be implemented as, for example, a television (TV). Also, the display apparatus 1 according to an embodiment of the disclosure may be implemented as an apparatus capable of outputting a content image, such as an electronic frame, a digital billboard, a large format display (LFD), a digital signage, a smart phone, a tablet, a mobile phone, a smart watch, etc. However, the display apparatus 1 according to an embodiment of the disclosure is not limited thereto and may be any apparatus capable of displaying an image.

The display apparatus 1 according to an embodiment of the disclosure includes a display 100 capable of displaying an image, a housing 200 which supports the display 100, and a loudspeaker 300 which is provided in a space inside the display apparatus 1 between the display 100 and the housing 200 and capable of outputting sound. However, the configuration of the display apparatus 1 shown in FIG. 1 is only an example, and the display apparatus 1 according to an embodiment of the disclosure may be implemented in another configuration. For example, the display apparatus 1 according to an embodiment of the disclosure may be implemented to additionally include a component other than those shown in FIG. 1 or implemented without some of the components shown in FIG. 1.

The display 100 displays an image. The display 100 may employ any method of displaying an image, and there is no limitation in implementing the display 100. The display 100 may be implemented as, for example, a liquid crystal display (LCD), a plasma display, a light-emitting diode (LED) display, an organic light-emitting diode (OLED) display, a surface-conduction electron-emitter display, a carbon nanotube display, a nanocrystal display, or the like. When the display 100 is implemented with an LCD, the display 100 includes an LCD panel, a backlight unit which provides light to the LCD panel, a panel driver, and the like. Alternatively, the display 100 may be implemented as an OLED panel which is a self-light emitting device without a backlight unit.

The housing 200 supports the display 100. Also, the housing 200 may be provided to accommodate other components (e.g., a power supply, a driving circuit, and a controller) which cause an image to be displayed on the display 100 and may provide the appearance of the display apparatus 1. The housing 200 may be formed of, for example, a plastic material. However, the material of the housing 200 is not limited to the plastic material and may include a metal material or the like by way of another example. The housing 200 may include a stand 201 which supports the display 100 from below.

The loudspeaker 300 is provided in the space between the display 100 and the housing 200 and outputs sound. The loudspeaker 300 may include front loudspeakers 301 and surround sound loudspeakers 302. In particular, the surround sound loudspeakers 302 may include a directional emitter 410 (FIG. 3) in which a plurality of holes are provided. A structure and operation of the surround sound loudspeakers 302 including the directional emitter 410 will be described in detail below.

The loudspeaker 300 may include a driver unit which drives the loudspeaker 300 to generate sound. A plurality of driver units may be provided according to a channel or frequency of an audio signal input to the loudspeaker 300. The driver units may include an electromagnet which receives an electrical signal and generates magnetic force and a diaphragm which is vibrated by the electromagnet and generates sound.

Figure 2:
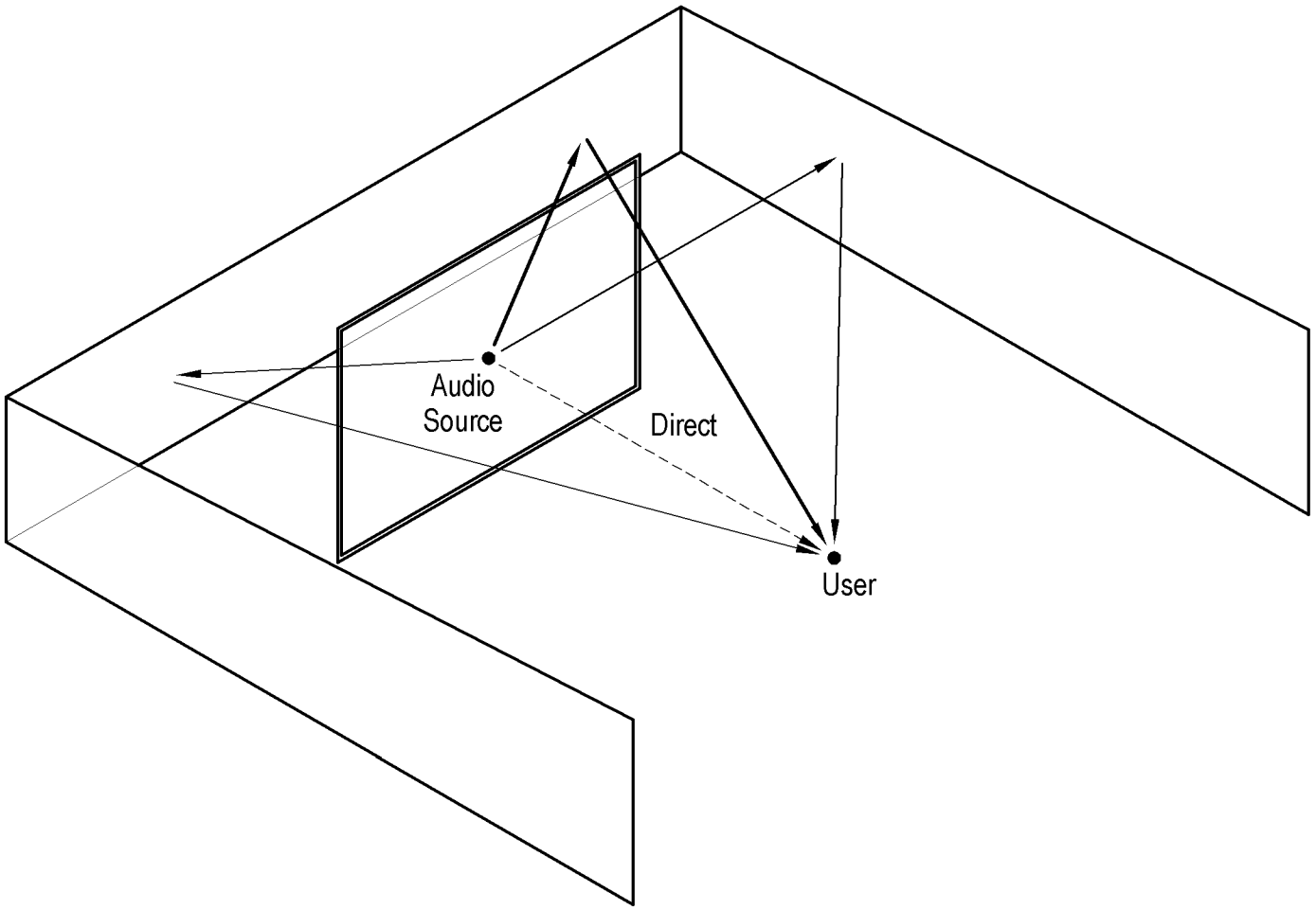
FIG. 2 is a diagram illustrating a path in which sound being output from a loudspeaker in a display apparatus is transmitted to a user of the display apparatus according to an embodiment of the disclosure.

FIG. 2 is a diagram showing a path in which sound output from a loudspeaker 300 is transmitted to a user of a display apparatus according to an embodiment of the disclosure.

The sound output from the loudspeaker 300 may reach to a user of the display apparatus 1 directly or indirectly. Sound output from the front loudspeakers 301 may directly reach to the user of the display apparatus 1. The front loudspeakers 301 may be disposed in the display apparatus 1 so that sound may be output in a frontward direction of the display apparatus 1, but the arrangement of the front loudspeakers 301 is not limited thereto. For example, when the display apparatus 1 has a slim design, the front loudspeakers 301 may be disposed in the display apparatus 1 facing downward as shown in FIG. 1 so that sound may be output downward.

The sound output from the surround sound loudspeakers 302 may be indirectly provided to the user of the display apparatus 1. For example, as shown in FIG. 2, sound output from the surround sound loudspeakers 302 may be reflected from a wall behind or beside the display apparatus 1, and the ceiling or the like above the display apparatus 1, and then reach to the user.

Figure 3:
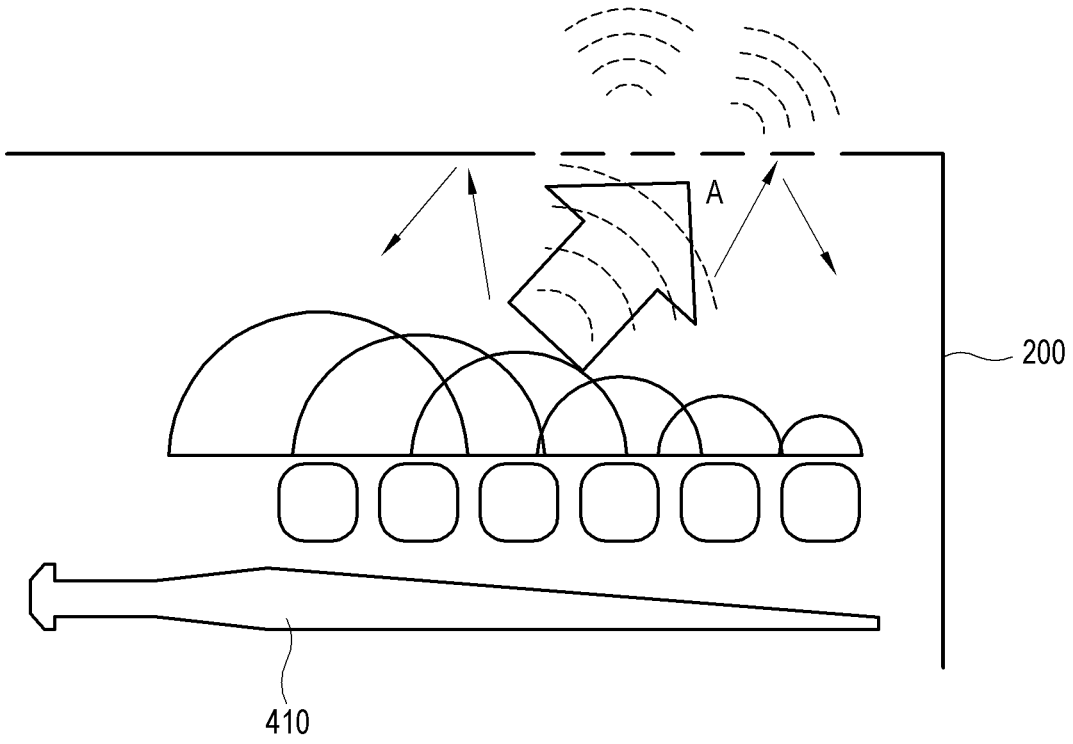
FIGS. 3 and 4 are diagrams schematically illustrating how quality of sound output from a loudspeaker is deteriorated within a housing of a display apparatus according to an embodiment of the disclosure.
Figure 4:
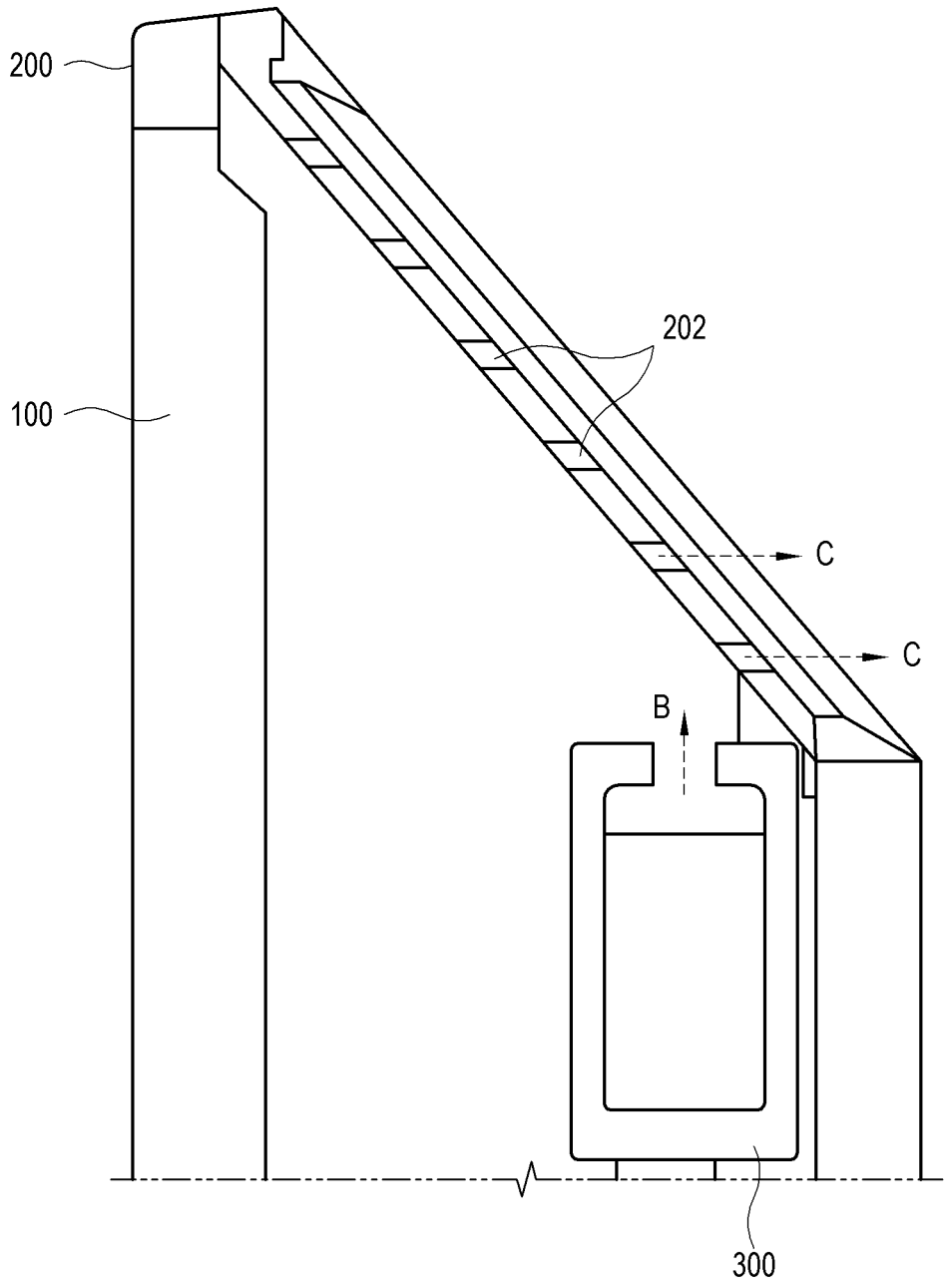

FIGS. 3 and 4 are diagrams schematically illustrating how quality of sound output from a loudspeaker 300 is deteriorated within a housing 200 of a display apparatus 1.

The loudspeaker 300 of the display apparatus 1 according to an embodiment of the disclosure is provided in the space provided between the display 100 and the housing 200 and outputs sound. Accordingly, when the sound output from the loudspeaker 300 is confined (i.e., bottled-up) or reflected within the housing 200, energy of sound emitted to the outside of the display apparatus 1, specifically, to the outside of the housing 200, is reduced, a sound field effect is deteriorated, and so on, thereby causing poor sound quality. For example, as shown in FIG. 3, when the loudspeaker 300 includes the directional emitter 410 in which a plurality of holes are provided, sound output from the directional emitter 410 has directivity, for example, in a direction A. Although the sound has the directivity, when the sound is confined or reflected within the housing 200 in the process of being emitted to the outside of the housing 200, the sound being output to the exterior of the housing 200, that is, sound provided to a user, is deteriorated in quality.

Meanwhile, vents 202, i.e., openings through which the sound output from the loudspeaker 300 passes to reach the exterior of the housing 200, may be formed in the housing 200. As shown in FIG. 4, the vents 202 may be provided in a form in which a plurality of through-holes are arranged side by side along the rear side of the housing 200. However, the shape of the vents 202, i.e., the orientation and the arrangement of the vents 202 are not limited thereto, and it is possible to use any design for outputting the sound from the housing 200 to the exterior of the housing 200.

When the direction of sound output from the loudspeaker 300 differs from the direction of the vents 202, sound quality may be deteriorated as mentioned above. For example, as shown in FIG. 4, the direction (a direction B in FIG. 4) of the sound output from the loudspeaker 300 may differ (in a perpendicular direction) from the direction (a direction C in FIG. 4) of the vents 202 provided in the housing 200. In this case, even when the loudspeaker 300 is provided as the directional emitter 410 and the sound output from the loudspeaker 300 has certain directivity, sound quality may be deteriorated as mentioned above.

Figure 5:
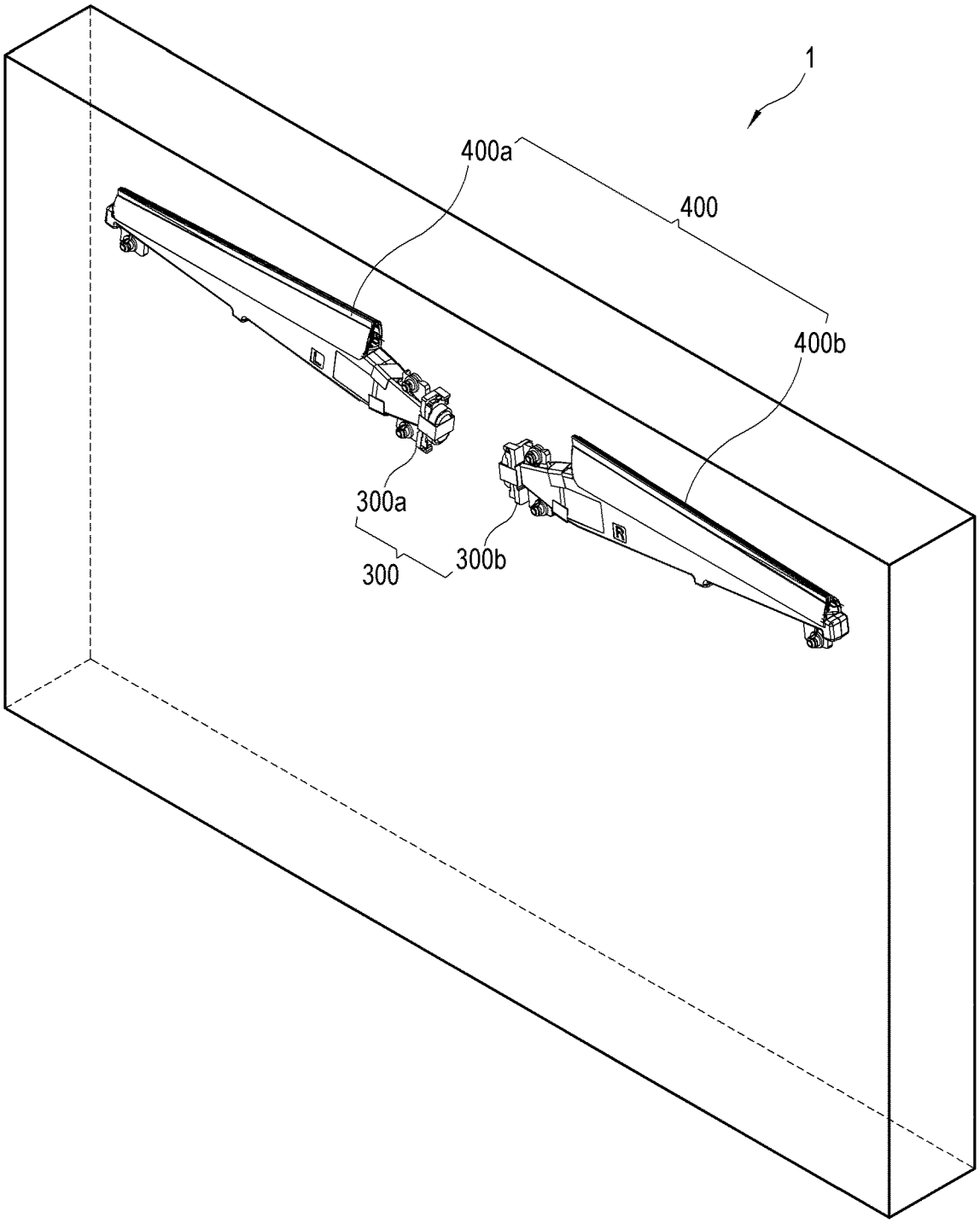
FIG. 5 is a perspective view of sound guides according to an embodiment of the disclosure.
Figure 6:
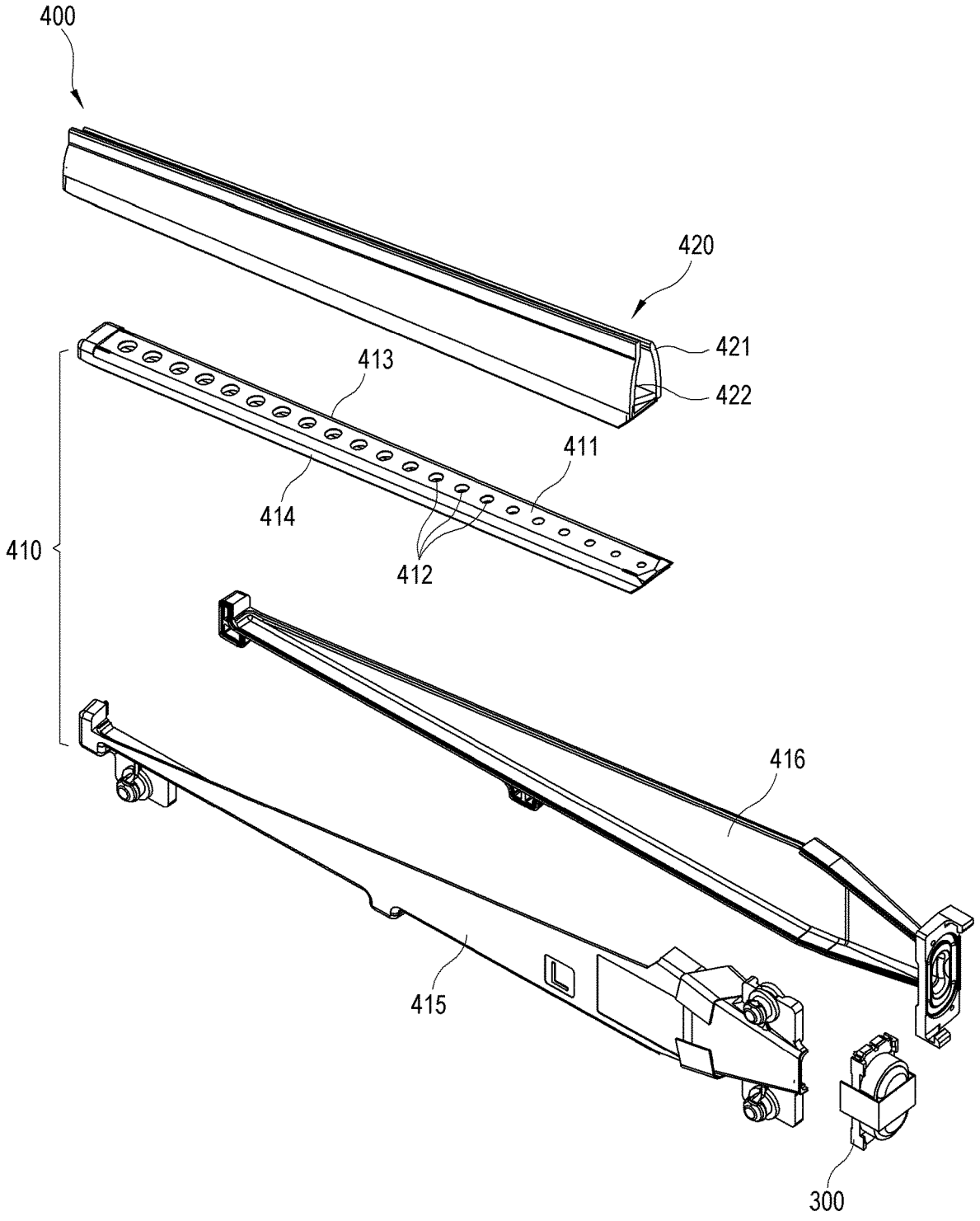
FIG. 6 is an exploded perspective view of a sound guide according to an embodiment of the disclosure.
Figure 7:
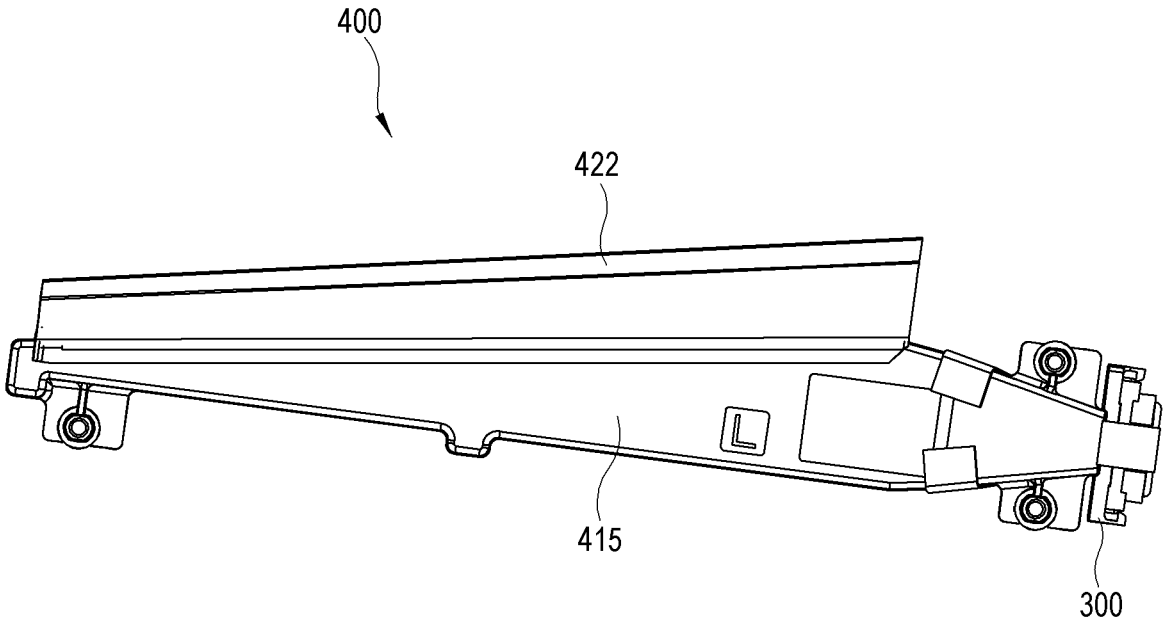
FIG. 7 is a front view of a sound guide according to an embodiment of the disclosure.
Figure 8:
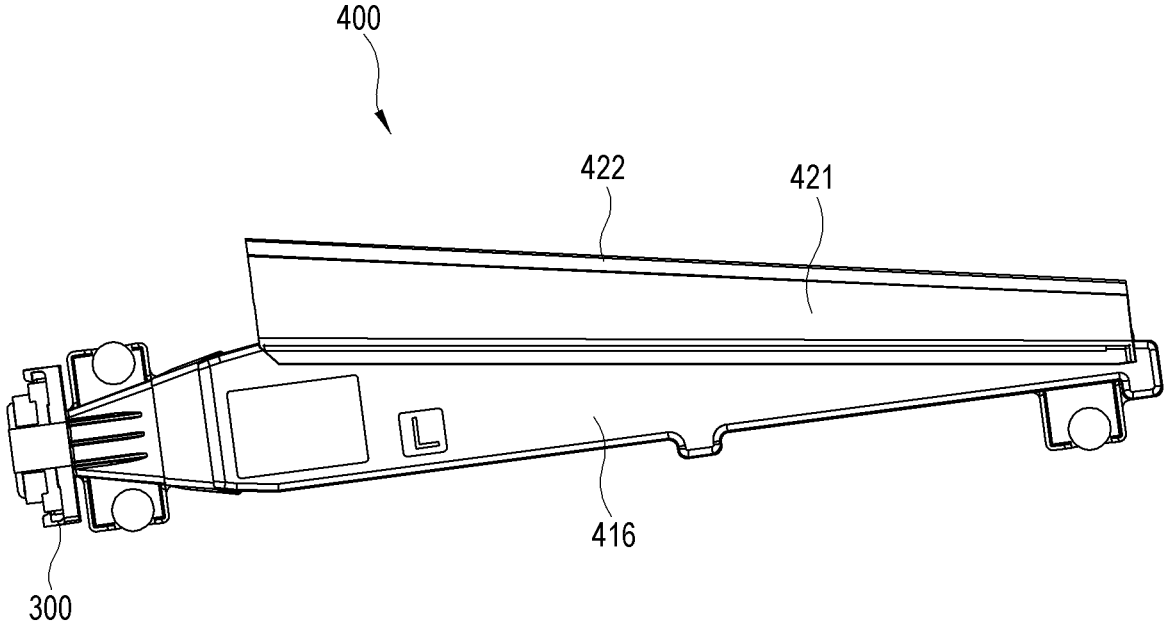
FIG. 8 is a rear view of a sound guide according to an embodiment of the disclosure.
Figure 9:
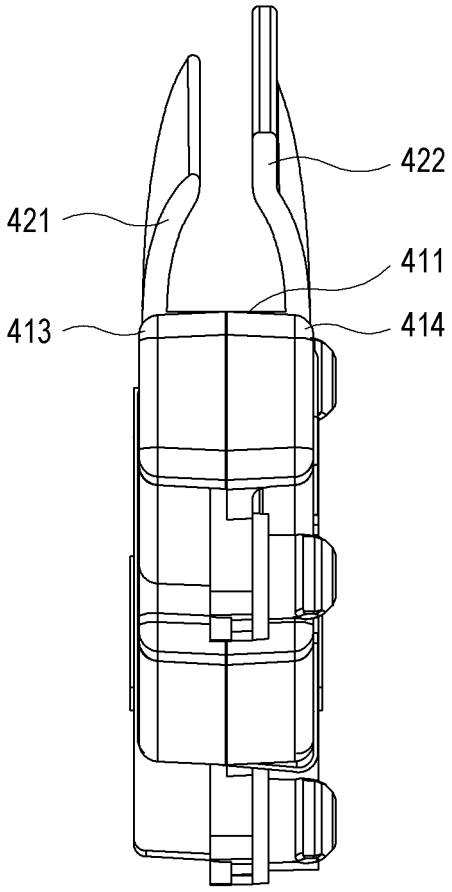
FIG. 9 is a left side view of a sound guide according to an embodiment of the disclosure.
Figure 10:
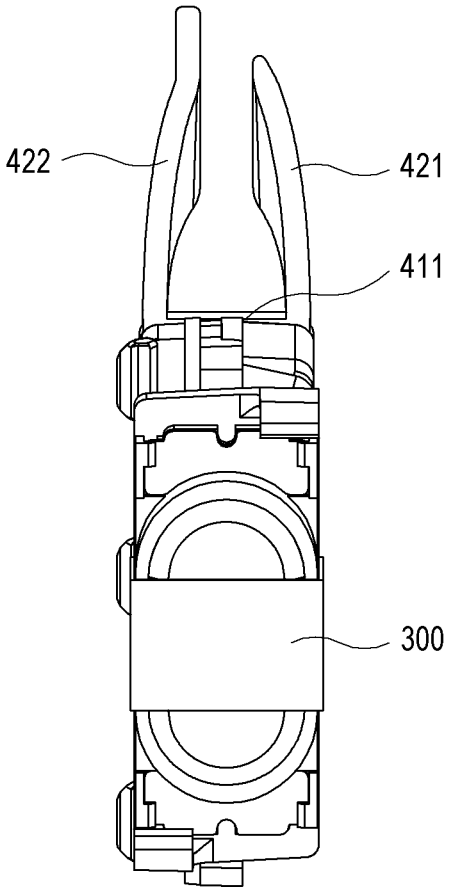
FIG. 10 is a right side view of a sound guide according to an embodiment of the disclosure.
Figure 11:
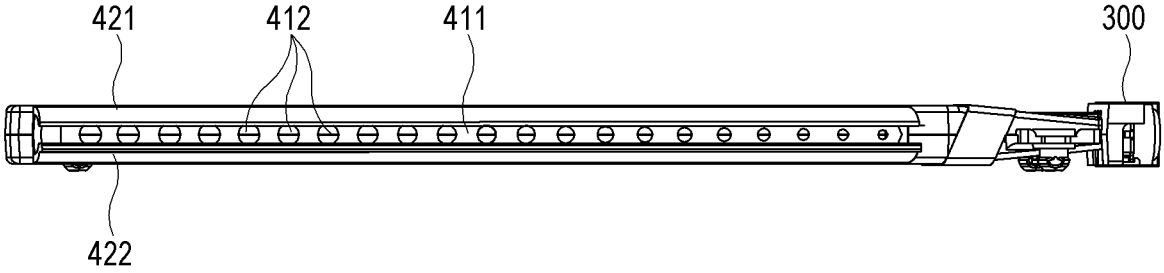
FIG. 11 is a top view of a sound guide according to an embodiment of the disclosure.
Figure 12:
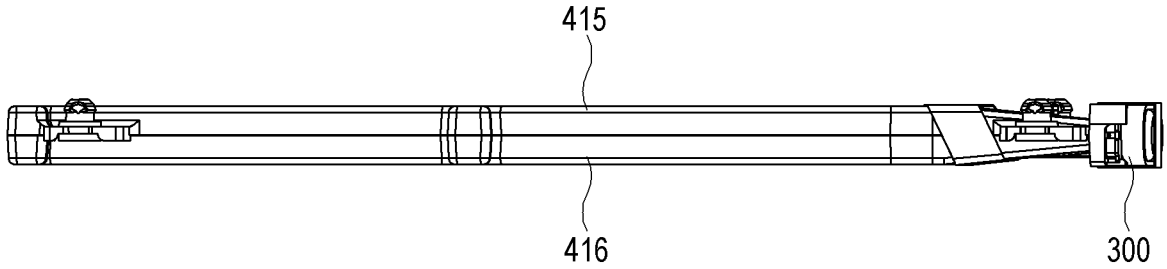
FIG. 12 is a bottom view of a sound guide according to an embodiment of the disclosure.
Figure 13:
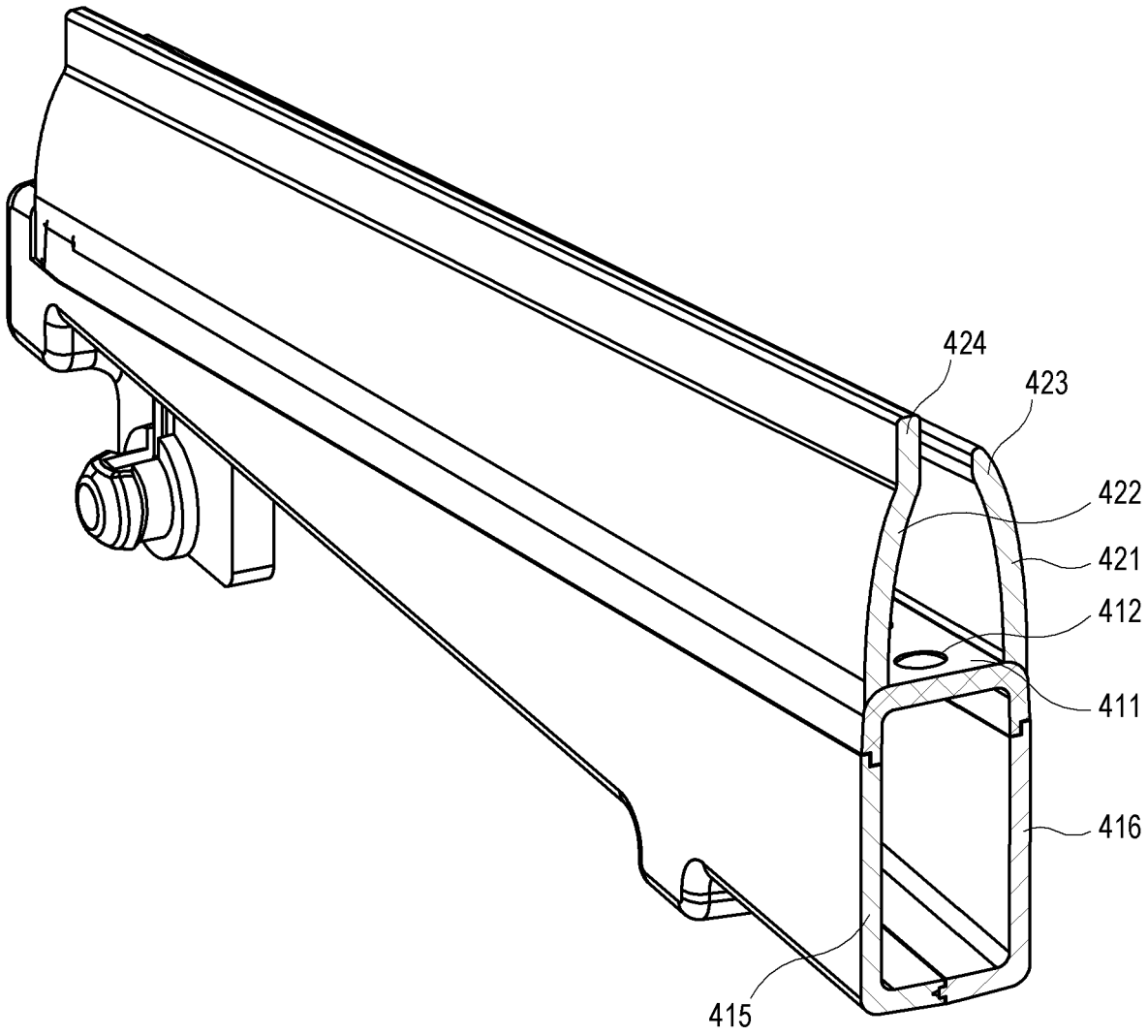
FIG. 13 is a cross-sectional view of a sound guide according to an embodiment of the disclosure.

The configuration of the display apparatus 1 according to an embodiment of the disclosure for solving the problem of sound quality deterioration will be described below with reference to FIGS. 5 to 13. FIG. 5 is a perspective view of sound guides 400 according to an embodiment of the disclosure, FIG. 6 is an exploded perspective view of a sound guide 400 according to an embodiment of the disclosure, FIG. 7 is a front view of a sound guide 400 according to an embodiment of the disclosure, FIG. 8 is a rear view of a sound guide 400 according to an embodiment of the disclosure, FIG. 9 is a left side view of a sound guide 400 according to an embodiment of the disclosure, FIG. 10 is a right side view of a sound guide 400 according to an embodiment of the disclosure, FIG. 11 is a top view of a sound guide 400 according to an embodiment of the disclosure, FIG. 12 is a bottom view of a sound guide 400 according to an embodiment of the disclosure, and FIG. 13 is a cross-sectional view of a sound guide 400 according to an embodiment of the disclosure.

The display apparatus 1 according to an embodiment of the disclosure includes the sound guide 400. The sound guide 400 is provided on the output side of the loudspeaker 300 and guides sound output from the loudspeaker 300. As shown in FIG. 5, the loudspeaker 300 and the sound guide 400 of the display apparatus 1 according to an embodiment of the disclosure may include one pair of loudspeakers 300*a* and 300*b* and one pair of sound guides 400*a* and 400*b* which are symmetrically disposed in the upper portion of the housing 200. As another example, a loudspeaker 300 and a sound guide 400 may be additionally provided in the left portion of the housing 200, and furthermore, a loudspeaker 300 and a sound guide 400 may be additionally provided in the right portion of the housing 200. For convenience of description, it is assumed below that the one pair of loudspeakers 300*a* and 300*b* and the one pair of sound guides 400*a* and 400*b* are symmetrically disposed in the upper portion of the housing 200.

The sound guide 400 includes the directional emitter 410 and a directional guide 420.

The directional emitter 410 has an internal space which extends along an output direction of the sound being output from the loudspeaker 300. The internal space of the directional emitter 410 is not limited to a specific cross-sectional shape. For example, the internal space of the directional emitter 410 may be given in a cylindrical shape, a rectangular parallelepiped shape, or another shape, which has a predetermined length in the output direction of sound being output from the loudspeaker 300.

In a first surface 411 of the directional emitter 410 facing a direction in which the output direction of sound output from the loudspeaker 300 is bent, a plurality of holes 412 are arranged along the output direction of sound.

According to the directional emitter 410 having the above-described structure, the sound which is output from the loudspeaker 300, passed through the directional emitter 410, and transmitted through the plurality of holes 412 of the first surface 411 has directivity in a direction in which the sound is output through the plurality of holes 412. Specifically, sound waves output from the loudspeaker 300 are transmitted with a time lag in the process of passing through the plurality of holes 412 of the directional emitter 410 arranged along the output direction of the sound being output from the loudspeaker 300. The sound waves transmitted with the time lag interfere with each other destructively or constructively and as a result have directivity in a direction in which the sound waves are output through the plurality of holes 412, for example, a direction A of FIG. 3.

There is no limitation in the overall shape of the directional emitter 410, the arrangement of the plurality of holes 412, the size of each hole 412, and the like. For example, the directional emitter 410 has a cross-sectional area which may be constant along the output direction of the sound being output from the loudspeaker 300 or may gradually increase or decrease in the longitudinal direction (i.e., the output direction of the sound being output from the loudspeaker 300). Also, the plurality of holes 412 may or may not be formed at regular intervals, and the size of each hole 412 may gradually increase or decrease. For convenience of description, it is assumed below that the cross-sectional area of the directional emitter 410 gradually decreases in the longitudinal direction, the size of each of the plurality of holes 412 increases in the longitudinal direction, and the plurality of holes 412 are provided at regular intervals as shown in FIG. 6.

Meanwhile, the sound guide 400 includes one pair of directional guides 421 and 422 respectively extending from two sides 413 and 414 of the first surface 411 between which the plurality of holes 412 of the directional emitter 410 are interposed. The one pair of directional guides 421 and 422 approach closer to each other in the propagation direction (or the sound output direction) of sound output through the plurality of holes 412. Each of the one pair of directional guides 421 and 422 may be provided in the form of a plate which has a length corresponding to the length of the two sides 413 and 414 of the first surface 411 of the directional emitter 410 (in the longitudinal direction), but the length and shape of the directional guide 420 is not limited thereto. Alternatively, for example, one of the one pair of directional guides 421 and 422 may be omitted. For convenience of description, it is assumed below that the one pair of directional guides 421 and 422 are both provided, and the individual directional guides 421 and 422 included in the one pair of directional guides 421 and 422 are also referred to as a first directional guide 421 and a second directional guide 422.

According to the directional guide 420 having the above structure, the directivity of the output sound is obtained in a certain direction. As the sound output from the loudspeaker 300 passes through the directional emitter 410, the degree of concentration of the sound further increases after passing through the directional guide 420. Accordingly, the amount of the output sound being confined or reflected within the housing 200 or another component in the housing 200 may be reduced. Consequently, the energy of sound emitted to the outside of the display apparatus 1 is increased, and the quality of sound output from the display apparatus 1 is improved.

According to an embodiment of the disclosure, the one pair of directional guides 421 and 422 may be provided in a symmetrical arrangement. For example, as shown in FIG. 17 illustrating a cross-sectional view of the directional guides 421 and 422 according to an embodiment of the disclosure, the one pair of directional guides 421 and 422 may be provided to be symmetrical to each other about a plane which is perpendicular to the first surface 411 of the directional emitter 410 in which the plurality of holes 412 are provided.

Figure 17:
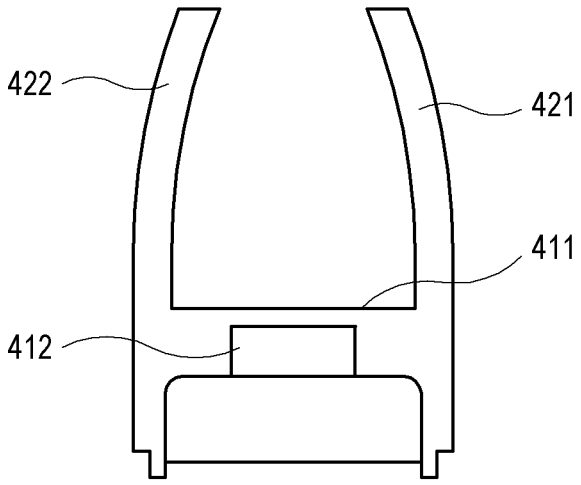
FIGS. 17 to 26 are diagrams illustrating display apparatuses, specifically, sound guides, according to various embodiments of the disclosure.

According to this structure of the embodiment in FIG. 17, it is possible to further increase the degree of concentration of the output sound passed through the plurality of holes.

Figure 14:
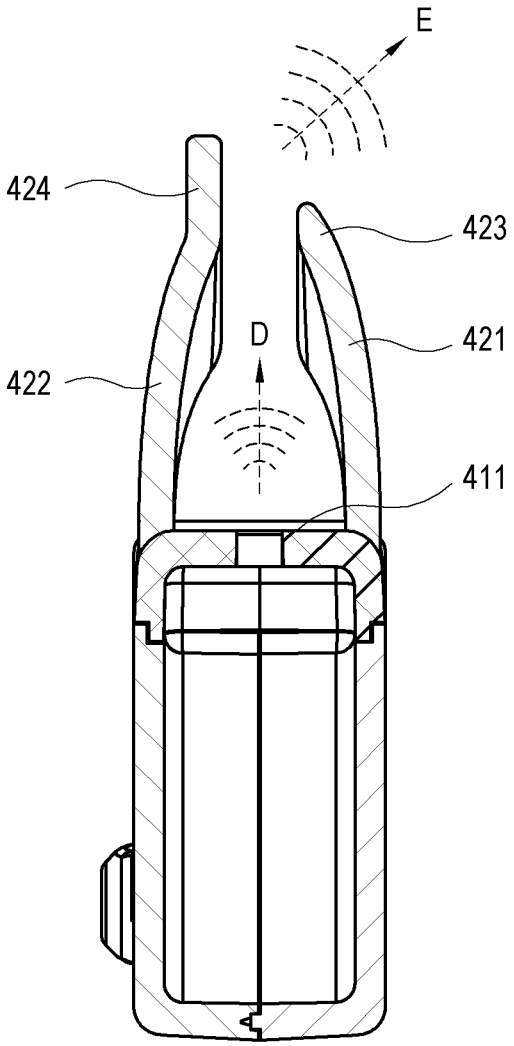
FIGS. 14 to 16 are diagrams illustrating effects of a sound guide in a display apparatus according to an embodiment of the disclosure.

Alternatively, according to an embodiment of the disclosure, an edge 424 (FIG. 13) of the second directional guide 422 may be extended further in the propagation direction of sound output through the plurality of holes 412. For example, as shown in FIGS. 13 and 14, the one pair of directional guides 420 may not be provided to be symmetrical to each other as shown in the embodiment in FIG. 17. Rather, an edge 423 of the first directional guide 421 may be directed toward the second directional guide 422, whereas the edge 424 of the second directional guide 422 may further extend from a shape corresponding to the edge 423 of the first directional guide 421 by a certain length in the propagation direction, or the output direction, of sound output from the plurality of holes 412. In this case, the first directional guide 421 may indicate one of the one pair of directional guides 420 which is close to the vents 202, and the second directional guide 422 may indicate the other one of the one pair of directional guides 420 which is farther from the vents 202 with respect to the first directional guide 421.

When the vents 202 are provided as a plurality of gaps 202*a*, 202*b*, 202*c*, 202*d* and 202*e* being arranged side by side, one of the one pair of directional guides 420 closer to the vents 202 may indicate a directional guide closer to a gap (e.g., 202*e* of FIG. 21) which is closest to the directional guides 420 among the plurality of gaps 202*a*, 202*b*, 202*c*, 202*d* and 202*e*.

According to this structure, because the direction of sound output from the loudspeaker 300 is changed toward the vents 202 of the housing 200, the opening direction of the housing vents 202 and the output direction of sound become identical or similar to each other. Therefore, the output sound passed through the directional guides 420 is easily emitted through the vents 202 of the housing 200, and it is possible to reduce the amount of the output sound being confined or reflected within the housing 200. Consequently, the quality of the output sound is improved.

Meanwhile, the first directional guide 421 and the second directional guide 422 may have the reverse shapes from each other. In other words, the first directional guide 421 may have the above-described shape of the second directional guide 422, and the second directional guide 422 may have the above-described shape of the first directional guide 421. In particular, according to the arrangement and shape of the vents 202, the first directional guide 421 and the second directional guide 422 may have the reverse shapes. Also, embodiments in which the output direction of the output sound passed through the directional guides 420 is identical or similar to the opening direction of the housing vents 202 have been mainly described above, but embodiments of the disclosure are not limited thereto. Embodiments of the disclosure may also include the reverse structure in which acoustic energy output toward the display 100 is reflected by the display 100 and directed toward the vents 202 of the housing 200. This is the same for all embodiments to be described below.

Figure 15:
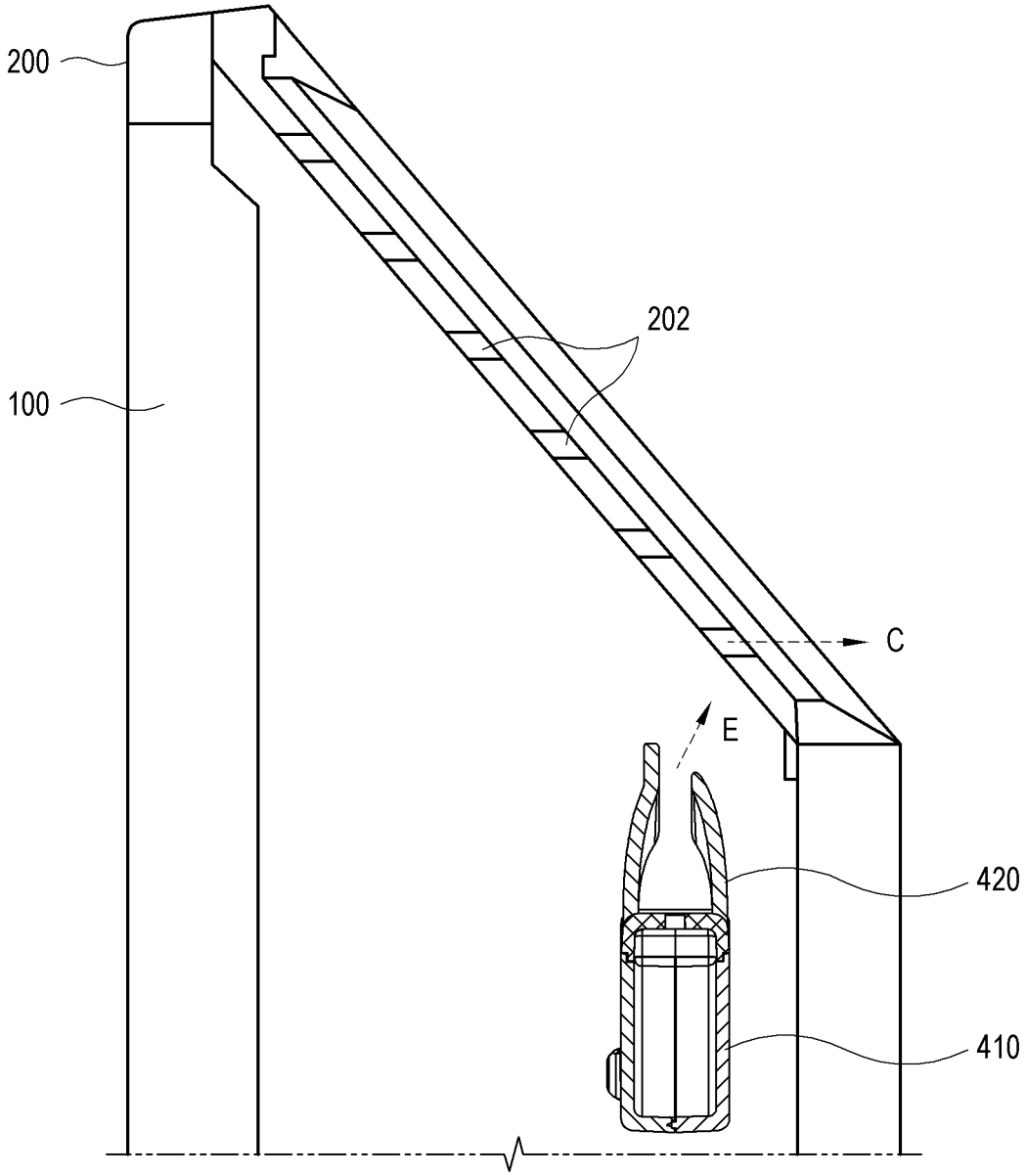

Effects of the above embodiments will be described in detail with reference to FIGS. 14 to 16.

As described above, when the sound output from the loudspeaker 300 is passed through the directional emitter 410 and transmitted to the plurality of holes 412, the sound has directivity in a direction in which the sound is output through the plurality of holes 412, that is, a direction (a direction D of FIG. 14) normal to the first surface 411 in which the plurality of holes 412 are provided. The sound which is output through the plurality of holes 412 to have directivity is concentrated more as the sound passes through the one pair of directional guides 420 which get closer to each other in the direction. Subsequently, the output sound passes through the edges 423 and 424 of the two directional guides and is transmitted to the outside of the directional guides 420. At this time, because the edge 424 of the second directional guide 422 extends further than the edge 423 of the first directional guide 421 in the propagation direction of the sound output through the plurality of holes 412, the output direction of the sound is tilted by a certain angle from the edge 424 of the second directional guide 422 toward the edge 423 of the first directional guide 421 (e.g., a direction E of FIG. 14).

Effects of the changed in sound output direction will be described by comparing the display apparatus 1 according to this embodiment with a display apparatus 1 of FIG. 4 which does not include the sound guide 400 of this embodiment. As described above, in FIG. 4, the direction of sound output from the loudspeaker 300 (a direction B of FIG. 4) crosses the direction of the vents 202 provided in the housing 200 (a direction C of FIG. 4) at right angles. Therefore, during the process in which sound output from the loudspeaker 300 passes through the vents 202 provided in the housing 200 and is transmitted to the exterior of the display apparatus 1, a large proportion of the sound is confined (bottled-up) or reflected within the housing 200 so that sound quality is as much deteriorated as the ratio.

On the contrary, when the vents 202 provided in the housing 200 are directed as shown in FIG. 4, the sound guide 400 according to this embodiment may be provided to the loudspeaker 300. In this case, as shown in FIG. 15, the direction of the output sound of the loudspeaker 300 is changed toward the vents 202 (a direction C of FIG. 15), that is, to a direction E of FIG. 15, as the output sound passes through the sound guide 400. Therefore, in the process in which the sound output from the loudspeaker 300 passes through the vents 202 provided in the housing 200 and is emitted to the outside of the display apparatus 1, a proportion of sound confined or reflected within the housing 200 is smaller than that of FIG. 4 so that the deterioration of sound quality is as much reduced as the difference.

Figure 16:
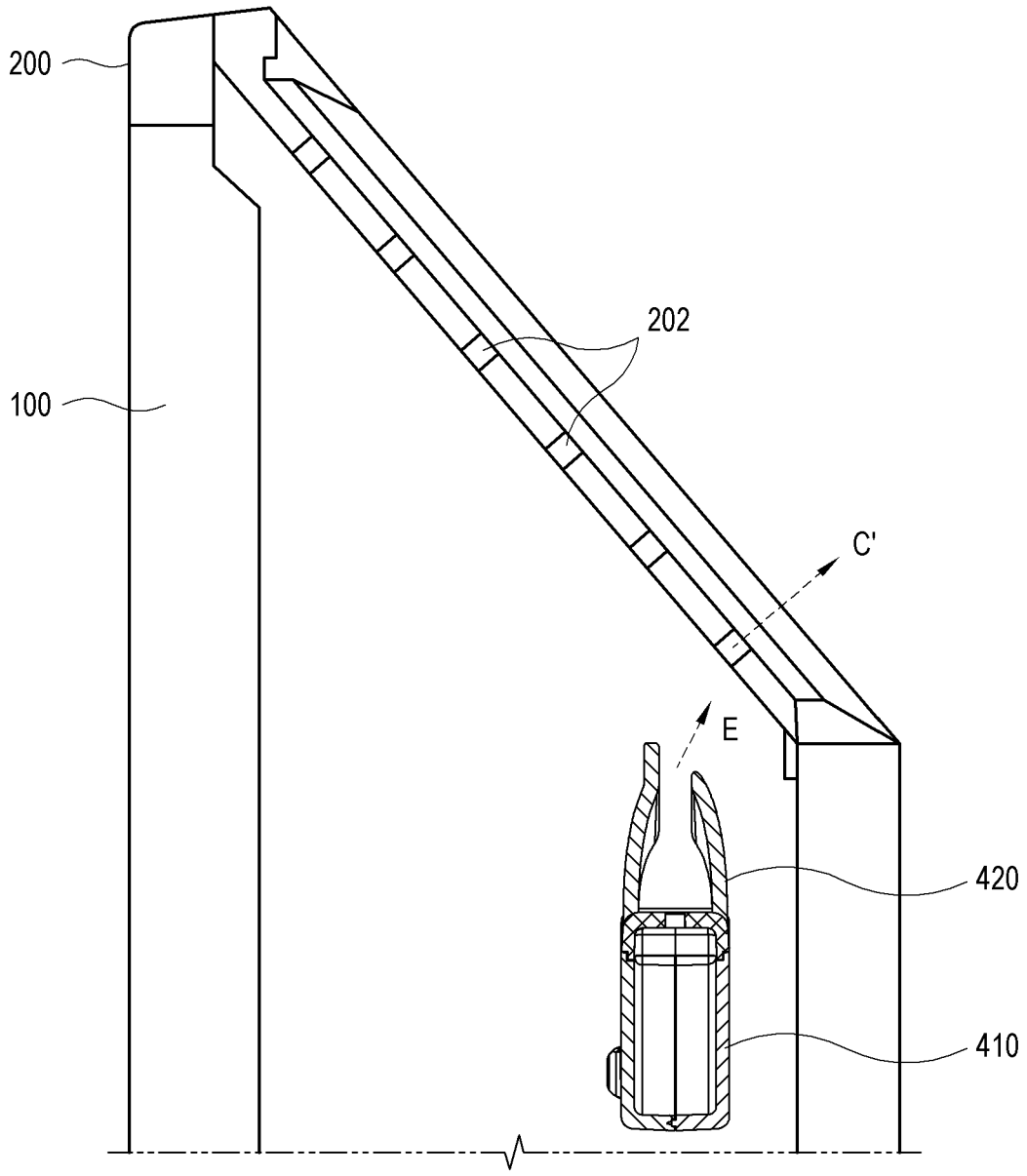

When the vents 202 are provided in a diagonal direction (a direction C' of FIG. 16) in the housing 200 as shown in FIG. 16, the direction of the sound changed while passing through the sound guide 400 (a direction E of FIG. 16) is almost aligned with the direction of the vents 202 so that the deterioration of sound quality is further reduced.

An embodiment has been described above in which the edge 424 of the second directional guide 422 is oriented in the propagation direction of the sound output through the plurality of holes 412. However, the extension direction of the edge 424 of the second directional guide 422 is not limited thereto and may be changed without limitations. In particular, the extension direction of the edge 424 of the second directional guide 422 may be identified according to the direction of the vents 202.

Meanwhile, an embodiment has been described above in which the direction of the output sound is changed through the structure of the edge 424 (FIG. 14) of the second directional guide 422, but the embodiment is not limited thereto. As another example, according to an embodiment of the disclosure, the loudspeaker 300 and the sound guide 400 may be disposed to be tilted by a certain angle toward the vents 202. This will be described with reference to FIG. 18.

Figure 18:
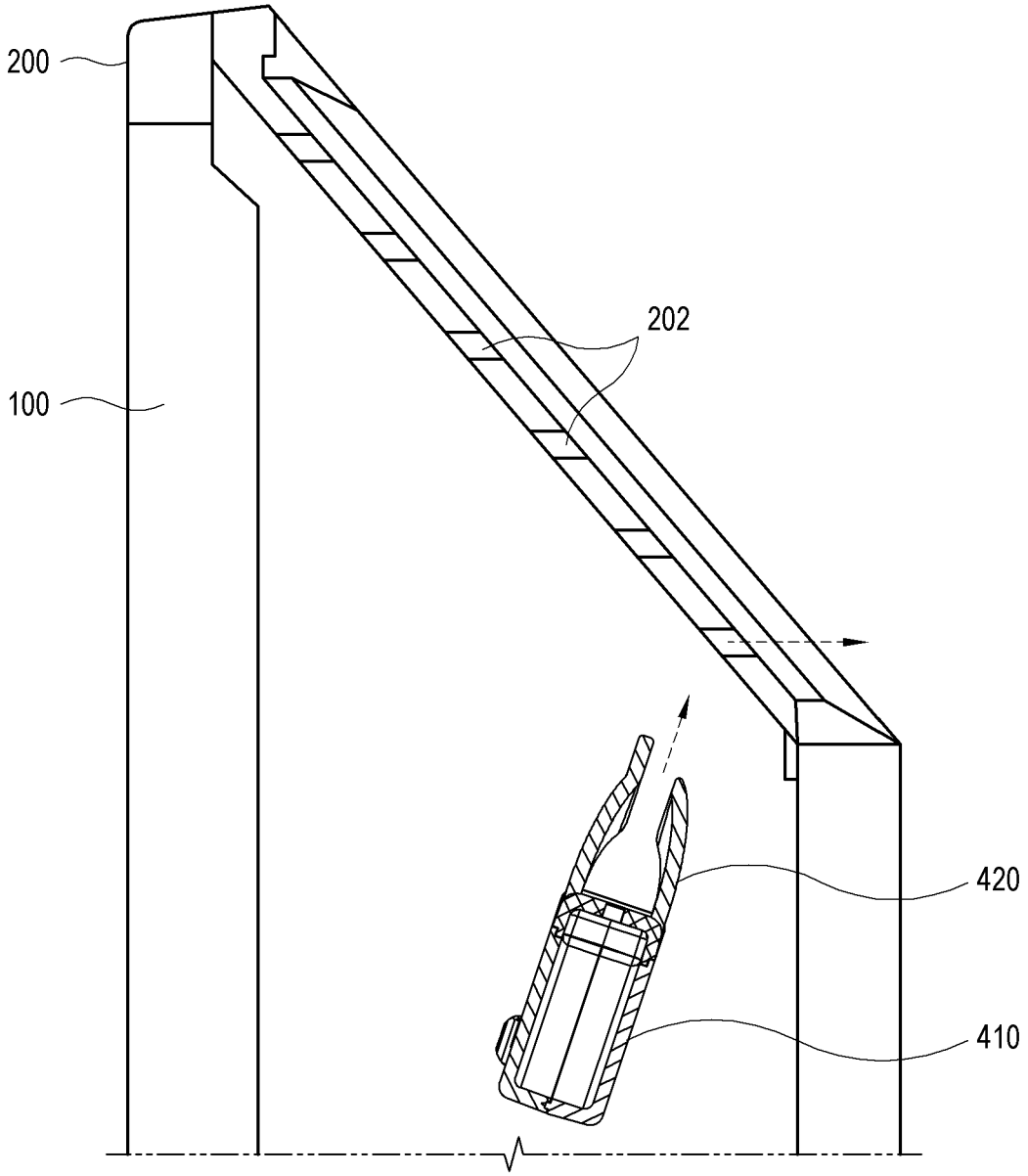

In the above-described embodiments, the propagation direction of sound output through the directional guide 420 is changed by directing the edge 424 of the second directional guide 422 in the propagation direction of the sound output through the plurality of holes 412. Unlike the above-described embodiment, in this embodiment, the loudspeaker 300 and the sound guide 400 may be tilted by a certain angle toward the vents 202 of the housing 200 as shown in FIG. 18 to show the same effects as the above embodiment. In this case, the one pair of directional guides 420 of the sound guide 400 may be provided to be symmetrical to each other as shown in FIG. 17.

According to this structure, it is possible to reduce a proportion of the output sound confined or reflected within the housing 200 by changing the output direction of sound according to the direction of the vents 202. Accordingly, the deterioration of sound quality is reduced to improve the sound quality.

Figure 19:
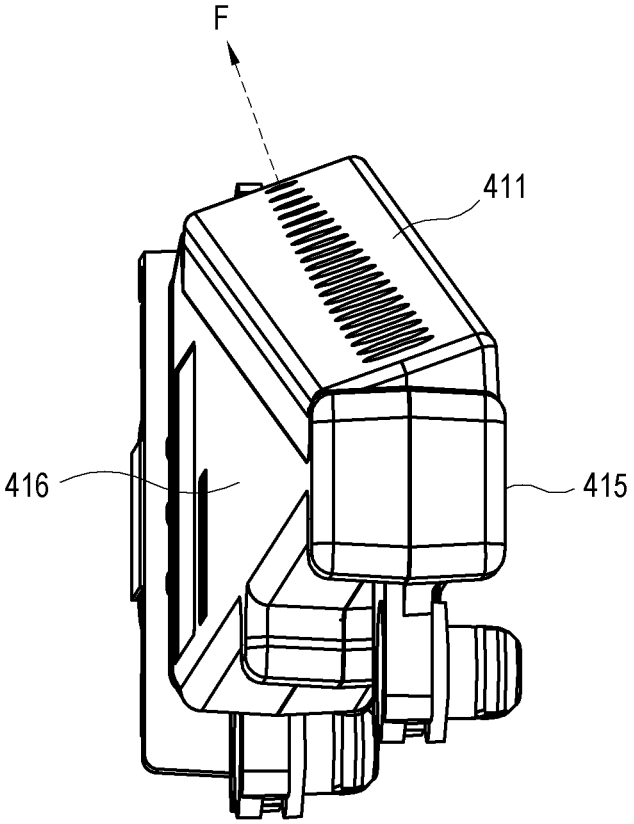
Figure 20:
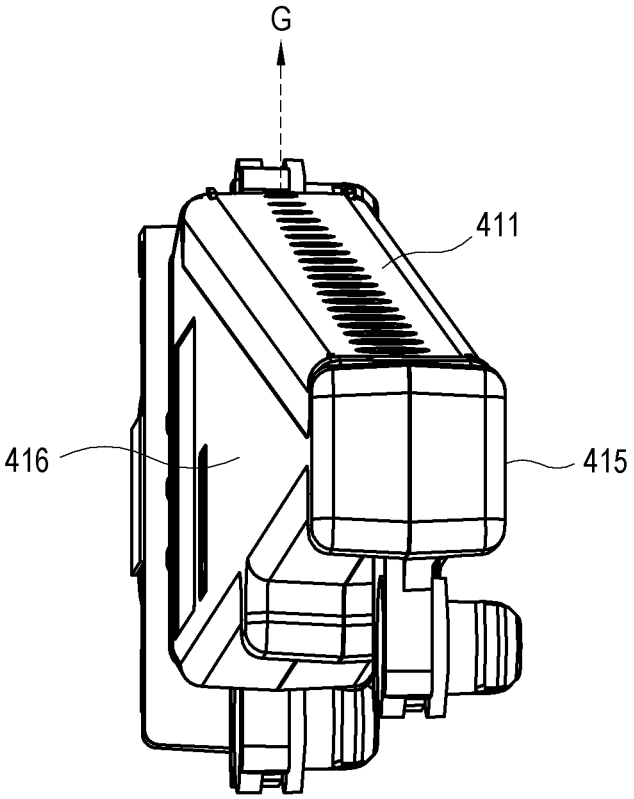

Alternatively, according to an embodiment of the disclosure, the output direction of sound may be changed by tilting the first surface 411 of the directional emitter 410, in which the plurality of holes 412 are provided, by a certain angle (toward the vents 202). This will be described with reference to FIGS. 19 and 20.

In the display apparatus 1 according to an embodiment of the disclosure, the first surface 411 in which the plurality of holes 412 are provided as an upper surface of the directional emitter 410 of the sound guide 400, and a first side surface 415 and a second side surface 416 of the directional emitter which are adjacent to the first surface 411 and face each other to form an internal space of the directional emitter 410 have different heights. In other words, according to this embodiment, because the first side surface 415 and the second side surface 416, that is, two side surfaces adjacent to the first surface 411 in which the plurality of holes 412 are provided, have different heights, the first surface 411 is formed to tilt by a certain angle. Accordingly, the propagation direction of sound output through the plurality of holes 412 provided in the first surface 411 (a direction F of FIG. 19) is as much changed as the tilt angle of the first surface 411. When this embodiment is compared with the embodiment of FIG. 20 in which the first side surface 415 and the second side surface 416 of the first surface 411 have the same height, the propagation direction of the sound output through the plurality of holes 411 in FIG. 19 (the direction F of FIG. 19) is changed by the tilt angle of the first surface 411 compared with the propagation direction of sound output through the plurality of holes 412 in FIG. 20 (a direction G of FIG. 20). In this embodiment, it is possible to change the direction of sound without the directional guide 420, and thus the directional guide 420 may be omitted.

According to this structure, it is possible to reduce a proportion of sound confined or reflected within the housing 200 by changing the output direction of sound according to the direction of the vents 202. Accordingly, the deterioration of sound quality is reduced so that the sound quality may be improved.

Figure 21:
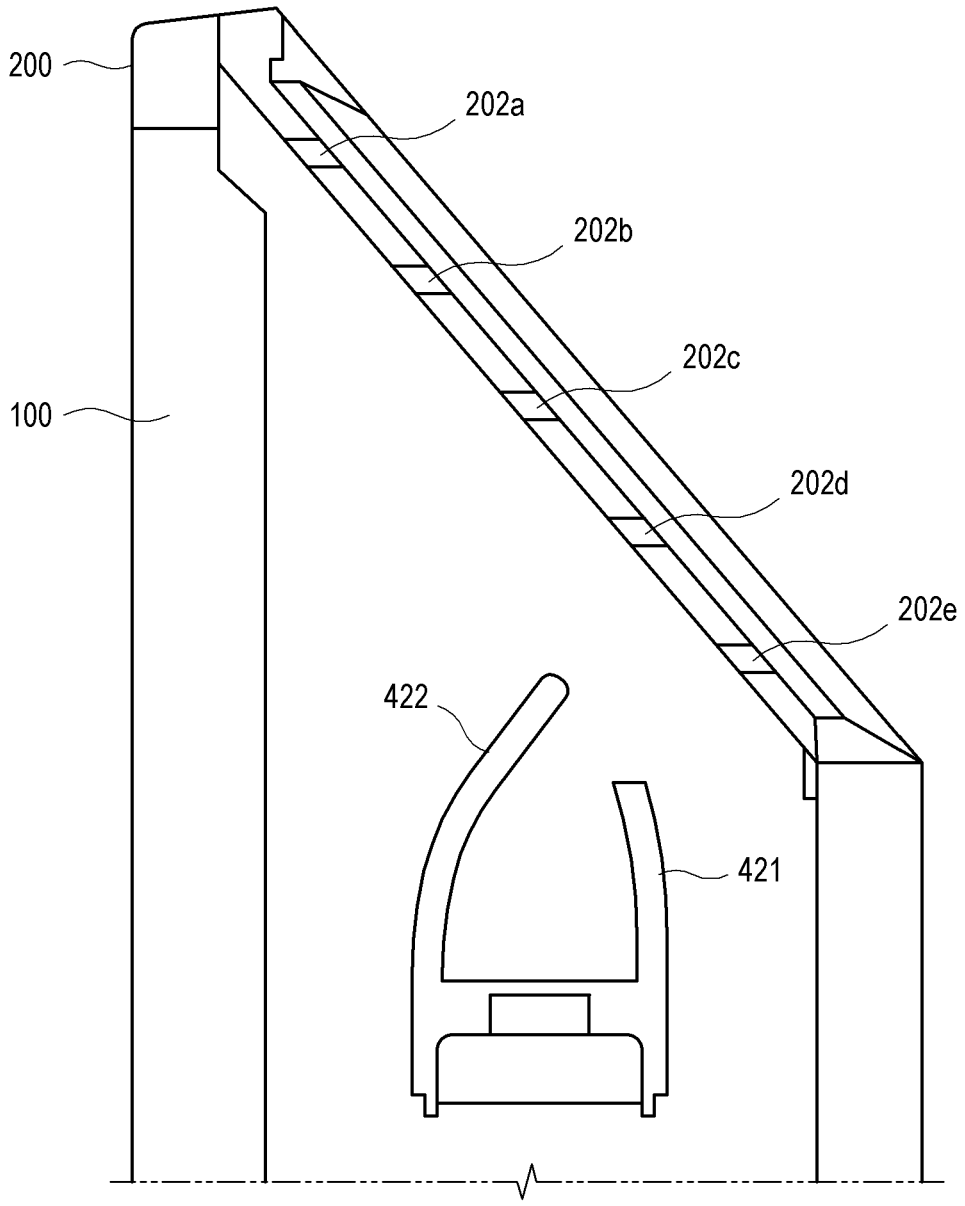

According to an embodiment of the disclosure, the length of the first directional guide 421, which is closer to the vents 202, between the one pair of directional guides 420 may be shorter than the length of the second direction guide 422. FIG. 21 is a diagram showing an example of this case. When the vents 202 are provided as the plurality of gaps 202*a*, 202*b*, 202*c*, 202*d* and 202*e* being arranged side by side, one of the one pair of directional guides 420 closer to the vents 202 may indicate a directional guide close to a gap (e.g., 202*e* of FIG. 21) which is closest to the directional guides 420 among the plurality of gaps 202*a*, 202*b*, 202*c*, 202*d* and 202*e*. Alternatively, in reverse, the length of the first directional guide 421 which is close to the vents 202 between the one pair of directional guides 420 may be longer than the length of the second direction guide 422 based on the placement of the plurality of gaps 202*a*, 202*b*, 202*c*, 202*d* and 202*e*.

According to this structure, because the direction of the sound output from the loudspeaker 300 is changed toward the vents 202 of the housing 200, a proportion of the sound confined or reflected within the housing 200 may be reduced. Accordingly, it is possible to reduce the deterioration of sound quality and improve surround effects.

Figure 22:
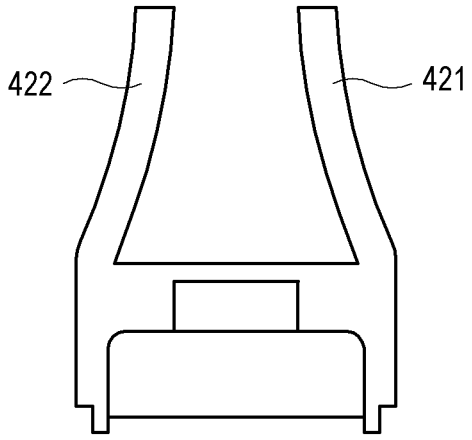
Figure 23:
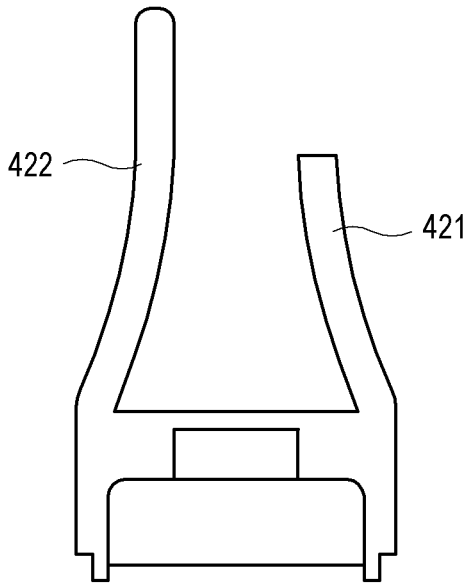
Figure 24:
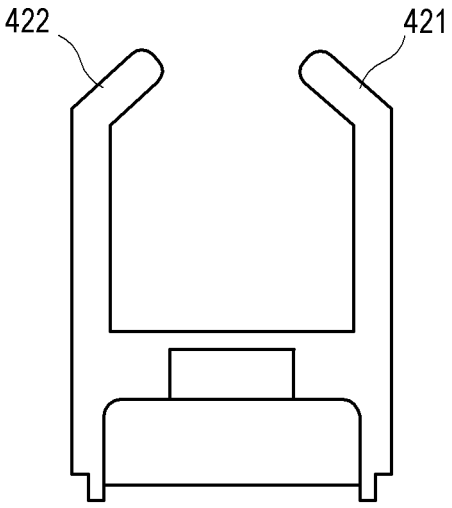
Figure 25:
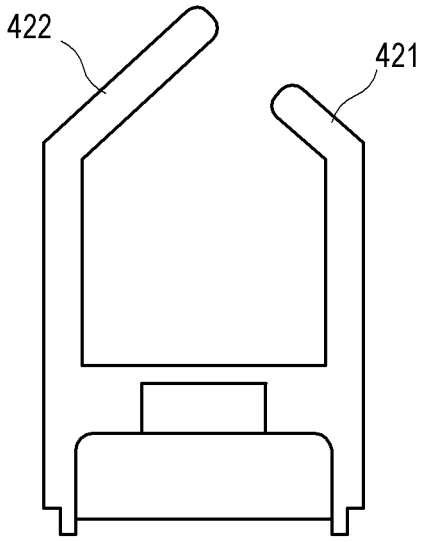

According to an embodiment of the disclosure, at least one of the one pair of directional guides 420 may be concave or convex. FIG. 17 and the like mentioned above shows an embodiment in which the one pair of directional guides 420 are both convex toward the exterior of the display apparatus 1, and FIG. 22 shows an embodiment in which the one pair of directional guides 420 are both concave with respect to the exterior of the display apparatus 1. Alternatively, the first directional guide 421 may be convex toward the exterior of the display apparatus 1, and the second directional guide 422 may be concave with respect to the exterior of the display apparatus 1, or vice versa. Otherwise, at least one of the one pair of directional guides 420 may include a bent portion as shown in FIG. 24. In each case, the first directional guide 421 and the second directional guide 422 may not be symmetrical to each other or may have different lengths as shown in FIGS. 21, 23, and 25.

According to these structures, it is possible to employ the directional guides 420 in an appropriate shape according to the arrangement of other components in the housing 200, the desired degree of concentration of the output sound, the degree of a directional change, the orientation of the directional guide 420, the shape of the directional guide 420, and/or the like. Therefore, the degree of freedom of designing the directional guides 420 and the suitability of the directional guides 420 are improved.

Figure 26:
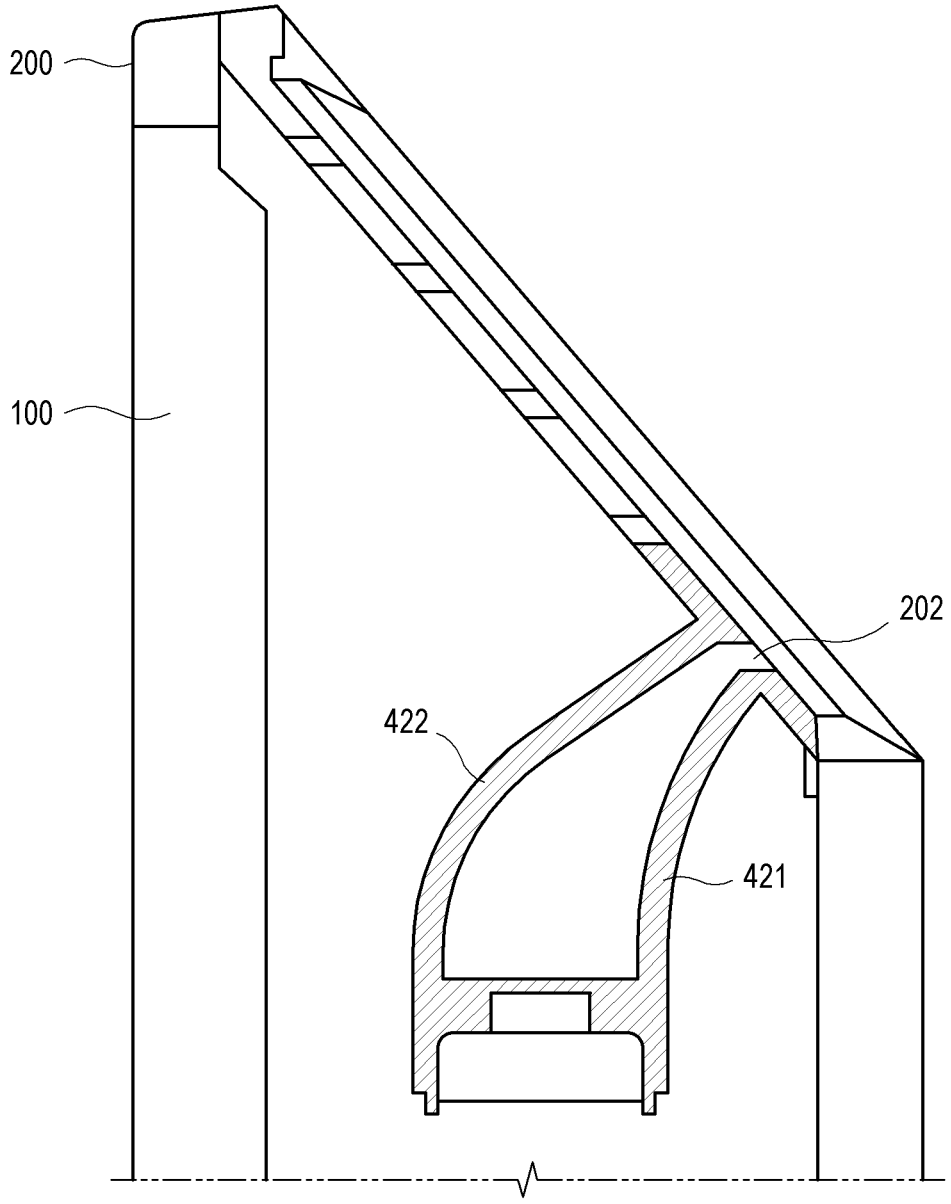

According to an embodiment of the disclosure, the directional guides 420 and the vents 202 may be integrally provided. For example, at least one directional guide 421 of the one pair of directional guides 420 may extend to come in contact with a vent 202 of the housing 200 and be integrally formed with the vent 202. FIG. 26 is a diagram showing an example of this case.

According to this structure, sound which is lost, confined, or reflected within the path from the directional guides 420 to the vents 202 of the housing 200 is hardly present or remarkably reduced so that the quality of output sound is improved.

As described above, according to the disclosure, it is possible to provide high-quality surround sound to a user of a display apparatus.

According to the disclosure, output sound whose directivity is obtained in a certain direction while the sound output from a loudspeaker passes through a directional emitter further increases in the degree of concentration after passing through a directional guide. Accordingly, the amount of the output sound being confined or reflected within a housing or another component in the housing may be reduced. Consequently, the energy of sound emitted to the outside of a display apparatus is increased, and the quality of sound output from the display apparatus is improved.

According to the disclosure, it is possible to further increase the degree of concentration of output sound passed through the plurality of holes.

According to the disclosure, it is possible to reduce the amount of sound output from a loudspeaker being confined or reflected within a housing by changing the direction of the output sound so that the quality of output sound is improved.

According to the disclosure, it is possible to reduce a proportion of sound confined or reflected within a housing of a display apparatus by changing the output direction of sound according to the direction of vents. Accordingly, it is possible to improve sound quality by reducing deterioration of sound quality.

According to the disclosure, it is possible to employ a directional guide in an appropriate shape according to the arrangement of other components in a housing of a display apparatus, the desired degree of concentration of output sound, the degree of a directional change, the orientation of a directional guide, the shape of the directional guide, and/or the like. Therefore, the degree of freedom of designing the directional guide and the suitability of the directional guide are improved.

According to the disclosure, sound which is confined, or reflected within the path from a directional guide to vents of a housing is hardly present or remarkably reduced so that the quality of output sound is improved.

Although embodiments have been shown and described, it will be appreciated by those skilled in the art that changes may be made therein without departing from the principles and spirit of the invention, the scope of which is defined in the appended claims and their equivalents.

What is claimed is:

1. A display apparatus comprising:
- a display configured to display an image;
- a housing configured to support the display;
- a loudspeaker provided between the display and the housing and configured to output sound; and
- a sound guide provided on the loudspeaker and configured to guide the sound output by the loudspeaker,
- wherein the sound guide comprises:
  - a directional emitter comprising:
    - an internal space extending in a first output direction of the sound; and
    - a plurality of holes arranged in the first output direction on a first surface facing a second output direction different from the first output direction; and
  - one pair of directional guides protruding from the first surface, the plurality of holes of the directional emitter being interposed between the one pair of directional guides, the one pair of directional guides approaching each other in the second output direction.

2. The display apparatus of claim 1, wherein the one pair of directional guides are symmetrical to each other.

3. The display apparatus of claim 1, wherein the housing comprises vents through which the sound output from the loudspeaker passes to an exterior of the housing.

4. The display apparatus of claim 1, wherein an edge of at least one of the one pair of directional guides extends in the second output direction.

5. The display apparatus of claim 3, wherein the sound guide is disposed to be tilted by a predetermined angle toward the vents with respect to the second output direction.

6. The display apparatus of claim 1, wherein the first surface corresponds to an upper surface of the sound guide, and
- a first side surface and a second side surface of the directional guide, which are adjacent to the first surface and face each other to form the internal space, have different heights in the second output direction.

7. The display apparatus of claim 3, wherein the one pair of directional guides comprises:

a first directional guide; and a second directional guide, and wherein the first directional guide, provided closer to the vents than the second directional guide, has a shorter length than the second directional guide in the second output direction.

8. The display apparatus of claim 3, wherein the one pair of directional guides comprises:

a first directional guide; and a second directional guide, and wherein the first directional guide, provided closer to the vents than the second directional guide, has a longer length than the second directional guide in the second output direction.

9. The display apparatus of claim 1, wherein at least one of the one pair of directional guides is concave or convex.

10. The display apparatus of claim 1, wherein at least one of the one pair of directional guides comprises a bent portion.

11. The display apparatus of claim 3, wherein the one pair of directional guides and the vents are integrally provided.

12. A display apparatus comprising:

a housing configured to support a display displaying an image and comprising a plurality of gaps;

a loudspeaker provided in the housing and configured to output sound through the plurality of gaps; and a sound guide configured to guide the sound output by the loudspeaker to the plurality of gaps, wherein the sound guide comprises:

a directional emitter configured to guide the sound in a first direction and comprising a plurality of holes arranged on a first surface of the sound guide, the plurality of holes facing a second direction different from the first direction;

a first directional guide; and a second directional guide, the first directional guide and the second directional guide protruding from the first surface toward the plurality of gaps, and wherein the first directional guide and the second directional guide are configured to further change the sound transmitted through the plurality of holes in the second direction toward the plurality of gaps.

13. The display apparatus of claim 12, wherein an edge of one of the first directional guide and the second directional guide extends in the second direction beyond an edge of the other one of the first directional guide and the second directional guide.

14. The display apparatus of claim 12, wherein the sound guide is tilted with respect to the second direction by a predetermined angle toward the plurality of gaps.

15. The display apparatus of claim 12, wherein at least one of the first directional guide and the second directional guide is concave or convex.

16. The display apparatus of claim 12, wherein at least one of the first directional guide and the second directional guide comprises a bent portion.

17. The display apparatus of claim 12, wherein the first directional guide, the second directional guide and the plurality of gaps are integrally provided.

18. A display apparatus comprising:

a housing configured to support a display displaying an image and comprising vents;

a loudspeaker provided in the housing and configured to output sound through the vents of the housing; and a sound guide configured to guide the sound output by the loudspeaker to the vents, wherein the sound guide comprises:

a directional emitter configured to guide the sound in a first direction and comprising a plurality of holes arranged on a first surface of the sound guide, the plurality of holes facing a second direction being perpendicular from the first direction;

a first directional guide; and a second directional guide, the first directional guide and the second directional guide protruding from the first surface toward the vents, and wherein the sound guide is tilted with respect to the second direction toward the vents.

19. The display apparatus of claim 18, wherein at least one of the first directional guide and the second directional guide is concave or convex.

20. The display apparatus of claim 18, wherein at least one of the first directional guide and the second directional guide comprises a bent portion.

* * * * *